US005425625A

United States Patent [19]

Hsu

[11] Patent Number: 5,425,625

[45] Date of Patent: Jun. 20, 1995

[54] CAR-USED ELECTRIC FUEL PUMP

[75] Inventor: Chi L. Hsu, Miao Li Hsien, Taiwan, Prov. of China

[73] Assignee: Lenco Enterprises Co., Ltd., Miao Li Hsien, Taiwan, Prov. of China

[21] Appl. No.: 216,835

[22] Filed: Mar. 24, 1994

[51] Int. Cl.[6] ..... F04B 35/04

[52] U.S. Cl. ..... 417/277; 417/410.4

[58] Field of Search ..... 417/410 C, 299

[56] References Cited

U.S. PATENT DOCUMENTS 2,184,133 12/1939 Wahlmart ..... 417/299

4,978,282 12/1990 Fu et al. ..... 417/410 C X

*Primary Examiner*—Richard E. Gluck

*Attorney, Agent, or Firm*—Browdy & Neimark

[57] ABSTRACT

A car-used electric fuel pump including a hollow housing enclosing a fuel inlet member, a fuel outlet board, a DC motor and a fuel outlet member, wherein the fuel outlet board is formed with an eccentric groove for receiving an outer and an inner rotors which are engaged with each other. By means of the rotation of the outer and inner rotors, a fuel-sucking and discharging effect is created. The DC motor is connected with the inner rotor by a connecting member for driving the inner rotor. The connecting member permits the motor to be assembled with the inner rotor without high accuracy so that the assembling procedure is facilitated. A gas-escaping valve is disposed on the fuel outlet member, whereby hot air or steam in the pump is able to escape therefrom to carry away heat and lower the temperature of the pump for avoiding danger.

2 Claims, 7 Drawing Sheets

CAR-USED ELECTRIC FUEL PUMP

BACKGROUND OF THE INVENTION

The present invention relates to an improved car-used electric fuel pump.

A conventional car-used electric fuel pump is shown in FIG. 1, wherein a fuel inlet member 11 is disposed at one end of a hollow housing 10. Referring to FIG. 2, a fuel inlet board 12, a middle ring member 13 and a fuel outlet board 16 are disposed on an inner side of the fuel inlet member 11 in sequence. The fuel inlet board 12 is formed with an arch fuel inlet 121 and an opposite pressure-balancing groove 122. An outer rotor 14 having inner teeth and an inner rotor 15 having outer teeth are engaged with each other and disposed in an eccentric hole of the middle ring member 13. The inner rotor 15 is formed with a central cross hole 151. An arch fuel outlet 161 is formed on the fuel outlet board 16 in alignment with the pressure-balancing groove 122 of the fuel inlet board 12. A DC motor 17 is disposed behind the fuel outlet board 16. A positive and a negative terminals of the motor are respectively connected with a positive and a negative electrodes 19 which are integrally molded together with a fuel outlet member 18. The motor 17 has a shaft 171 a front of which is cross-shaped for inserting into the central cross hole 151 of the inner rotor 15 for driving the same.

Please refer to FIG. 3. When the DC motor 17 drives both the inner rotor 15 and the outer rotor 14 to synchronously rotate, the space between the inner and outer rotors near the fuel inlet 121 is gradually increased and the fuel is sucked inward, while the space between the inner and outer rotors near the fuel outlet 161 is gradually reduced so that the sucked inward fuel is further discharged from the fuel outlet 161 to flow through the DC motor 17 outside the fuel outlet member 18.

In the above arrangement, because the outer rotor 14 is driven by the inner rotor 15 to eccentrically rotate relative to the middle ring member 13, the middle ring member 13 must be assembled with the fuel outlet board 16 with quite accurate alignment. Otherwise, in case of a slight error, the outer rotor 14 is likely to fail to rotate. Moreover, the motor shaft 171 is connected with the inner rotor 15 by means of accurately inserting the front end of the shaft 171 into the central cross hole 151 of the inner rotor 15. In case the central axial line of the assembly of the middle ring member 13, outer rotor 14 and inner rotor 15 is deflected from the central axial line of the motor, the operation will be unsmooth.

Therefore, it is necessary to provide an improved car-used electric fuel pump to eliminate the above shortcomings existing in the prior art.

SUMMARY OF THE INVENTION

It is a primary object of the present invention to provide an improved car-used electric fuel pump wherein a fuel outlet board made of engineering plastic is formed with an eccentric groove for directly receiving the inner and outer rotors so as to reduce the unsmoothness of operation occurring due to assembling error and the noise. In addition, the motor shaft is connected with the inner rotor by a connecting member so that even a difference between the central axial lines of the motor shaft and the inner rotor exists, the pump can still normally operate.

It is a further object of the present invention to provide the above fuel pump, wherein a gas-escaping valve is disposed on the fuel outlet member, whereby hot air or steam in the pump can escape through the gas-escaping valve for lowering the temperature of the pump.

DETAILED DESCRIPTION OF THE PREFERRED EMBODIMENTS

Figure 4:
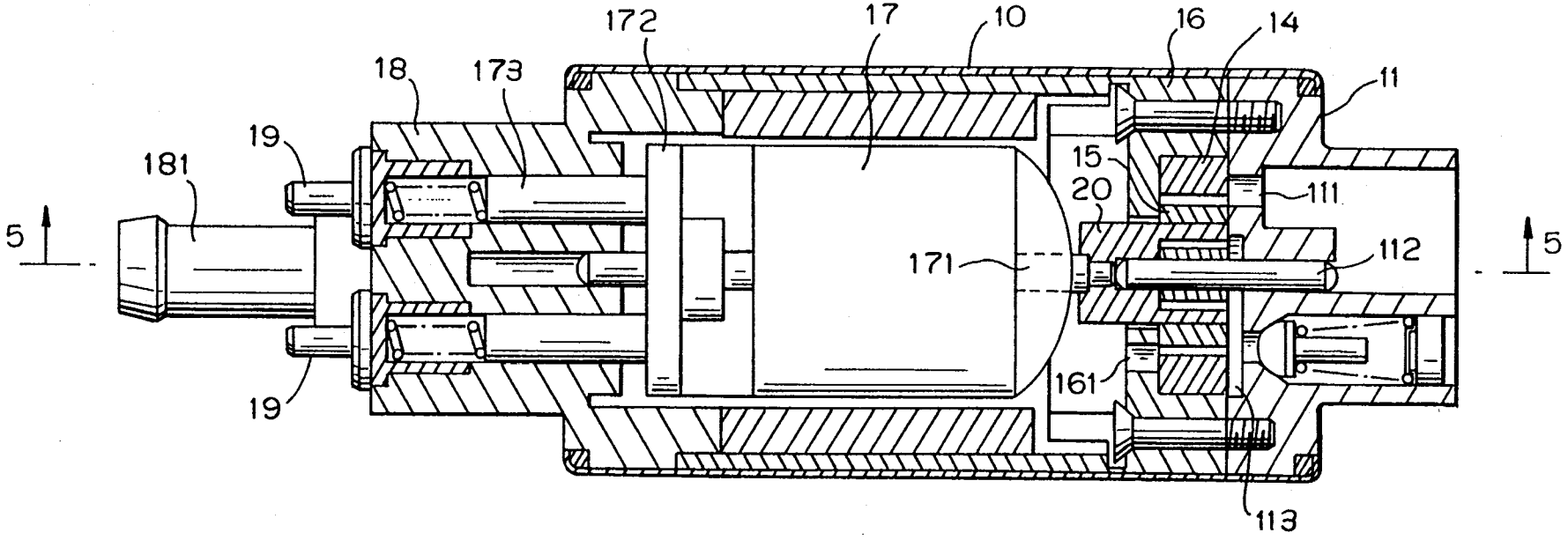
FIG. 4 is an assembled sectional view of a first embodiment of the car-used electric fuel pump of the present invention.
Figure 5:
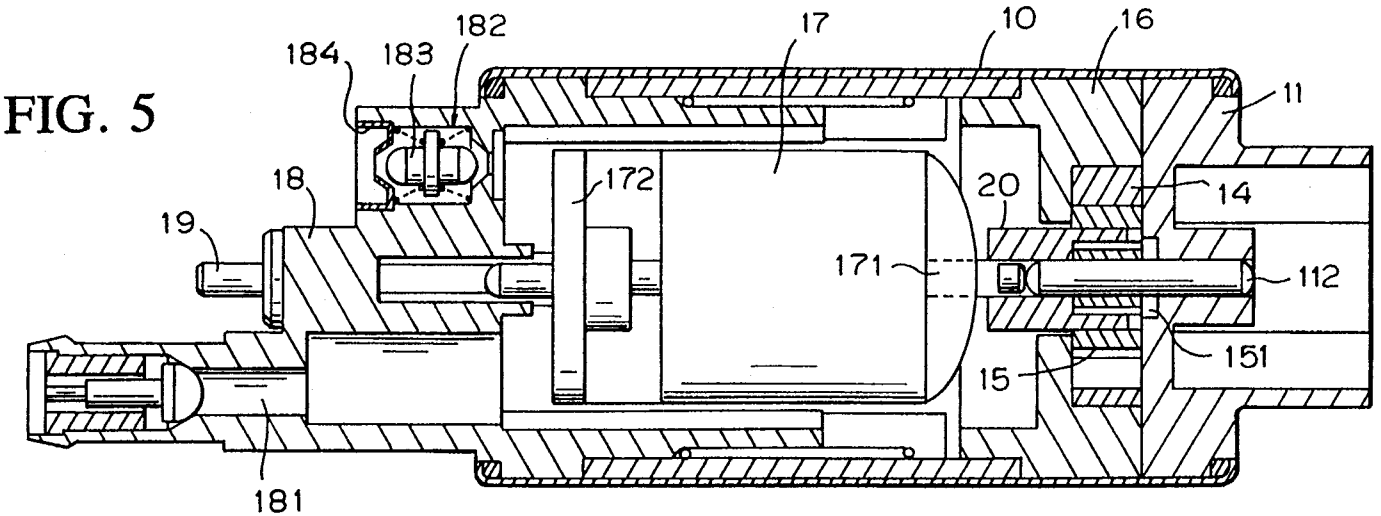
FIG. 5 is a sectional view taken along line 5—5 of FIG. 4.
Figure 6:
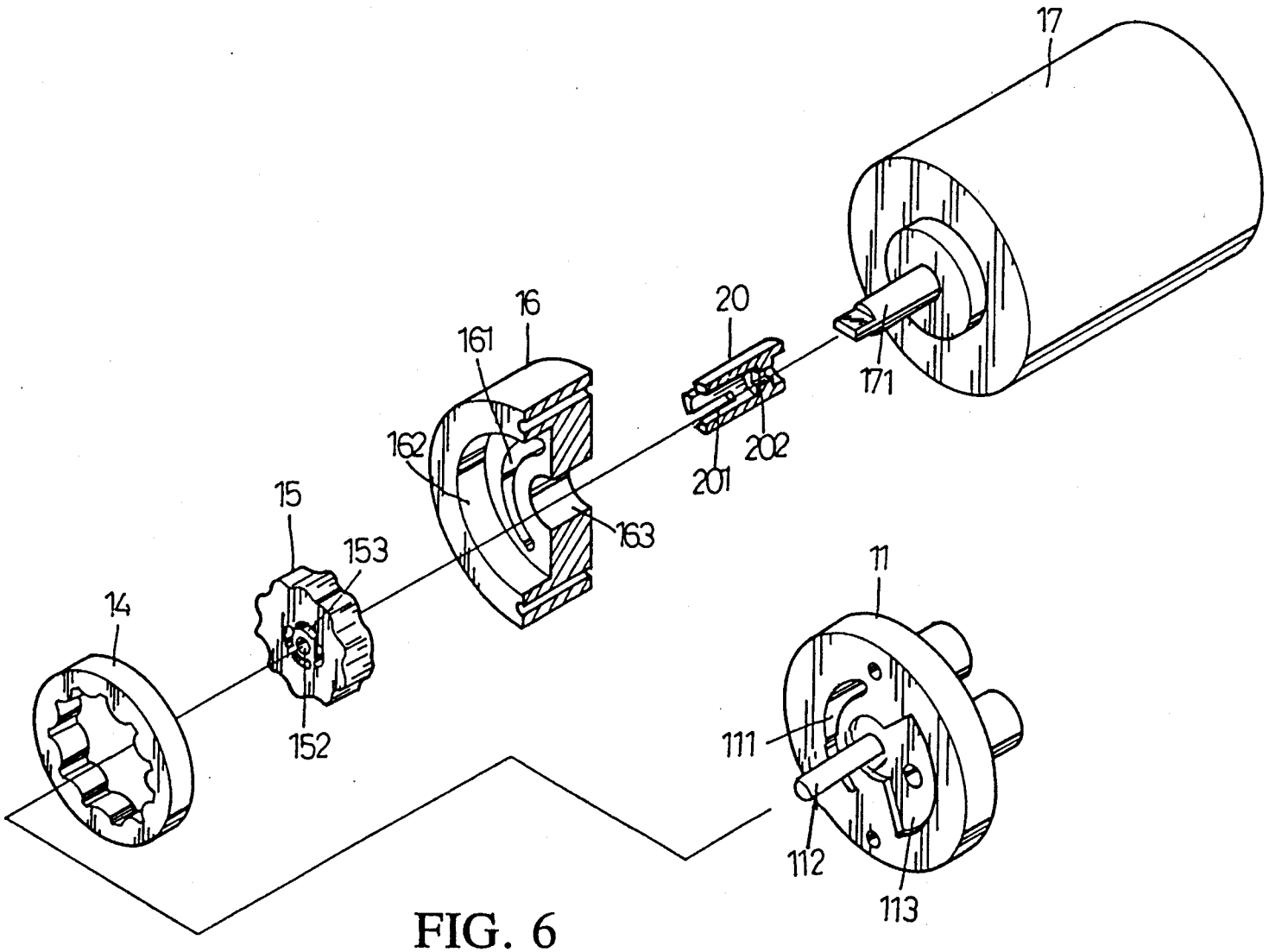
FIG. 6 is an exploded view of a part of the present invention.

Please refer to FIGS. 4, 5 and 6. The car-used electric fuel pump of the present invention includes a cylindric hollow housing 10, a fuel inlet member 11 fixedly disposed at one end of the housing 10, a fuel outlet board 16 connected with the fuel inlet member 11, an inner rotor 15 having a central hole 152 and outer teeth and an outer rotor 14 having inner teeth. The inner rotor 15 is disposed in the outer rotor 14 with the outer teeth of the inner rotor 15 engaged with the inner teeth of the outer rotor 14.

The fuel inlet member 11 is formed with an arch fuel inlet 111, an opposite pressure-balancing groove 113 and an inward projecting central fixing shaft 112. The fuel outlet board 16 is made of engineering plastic and an eccentric groove 162 is formed on one side of the fuel outlet board 16 near the fuel inlet member 11. A fuel orifice 161 is formed on the eccentric groove 162 in alignment with the pressure-balancing groove 113 of the fuel inlet member 11. The fuel outlet board 16 is formed with a central through hole 163. The engaged inner and outer rotors 15, 14 are disposed in the eccentric groove 162 of the fuel outlet board 16. The fixing shaft 112 of the fuel inlet member 11 extends through the central hole 152 of the inner rotor 15 and several arch holes 153 are formed around the central hole 152.

A DC motor 17 is disposed in the housing 10 behind the fuel outlet board 16. A fuel outlet member 18 is disposed at the other end of the housing 10 behind the DC motor 17. The DC motor 17 includes a shaft 171 having a flat front end, a brush seat 172 and two brushes 173 contacting with a positive and a negative electrodes 19 for connecting with external power source. The positive and negative electrodes 19 and the fuel outlet member 18 are integrally molded. As shown in FIG. 5, the fuel outlet member 18 is formed with a fuel outlet 181 and provided with a gas-escaping valve chamber 182 communicating with inner space of the housing 10. A gas-escaping valve 183 is disposed in the gas-escaping valve chamber 182. Two ends of the gas-escaping valve 183 are semi-spherically shaped and an annular projection is formed on a middle section of the gas-escaping valve 183. Two springs abut against two sides of the annular projection. A gas-escaping valve stopper plate 184 having a truncately conic opening is disposed at an exit of the gas-escaping valve chamber 182, whereby when the pressure in the pump is relatively low, the gas-escaping valve 183 is opened, permitting hot air or steam to escape from the chamber 182 and carry away heat. As a consequence, the temperature of the pump is lowered to avoid over-heating of the pump which may cause danger.

As shown in FIG. 6, the DC motor 17 is connected with the inner rotor 15 by a cylindric hollow connecting member 20 for driving the inner rotor 15. The connecting member 20 is made of engineering plastic and disposed through the central through hole 163 of the fuel outlet board 16. One end of the connecting member 20 is formed with several arch projecting claws 201 which extend into the arch holes 153 of the inner rotor 15. The area of cross-section of the projecting claw 20 is smaller than that of the arch hole 153 so that the projecting claw 201 is able to move within the arch hole 153 to a certain extent. The other end of the connecting member 20 is formed with a rectangular hole 202 through which the flat front end of the shaft 171 of the motor 17 extends. Similarly, the flat front end of the shaft 171 is able to move within the rectangular hole 202 to a certain extent. Because the shaft 171 is connected with the connecting member 20 with a freedom of moving and the connecting member 20 is similarly connected with the inner rotor 15 with a freedom of moving, the high accuracy of connection between the motor 17 and the inner rotor 15 is no more required so that the connecting procedure is facilitated and quickened.

Figure 8:
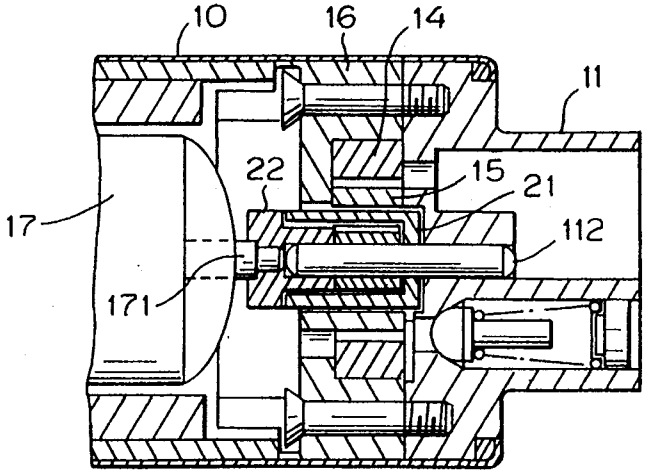
FIG. 8 is an assembled sectional view of a part of the second embodiment of the present invention.
Figure 7:
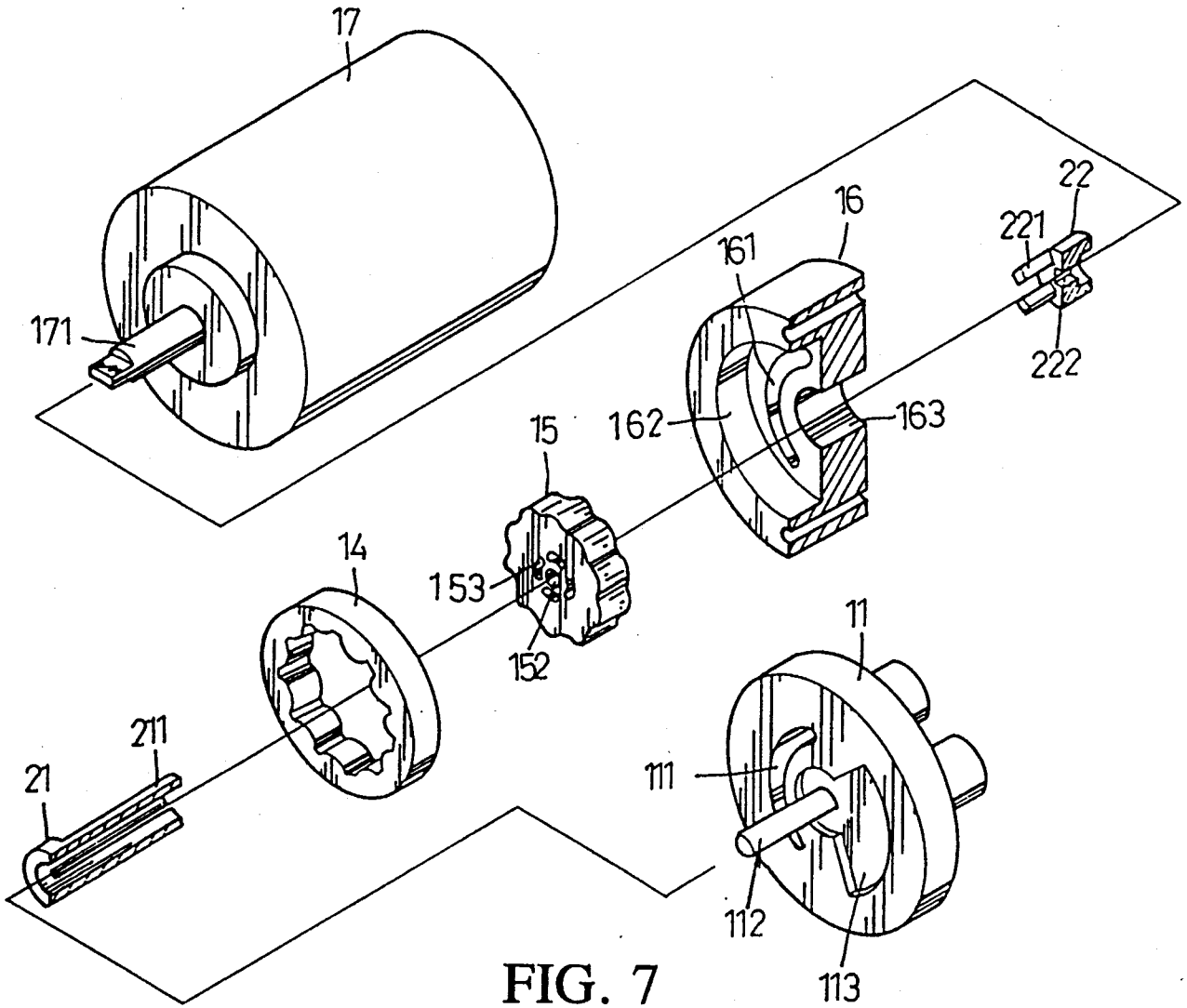
FIG. 7 is an exploded view of a part of a second embodiment of the present invention.

FIGS. 7 and 8 show another embodiment of the connecting member for connecting the shaft of the motor and the inner rotor, wherein an outer connecting member 21 is fitted with the fixing shaft 112 of the fuel inlet member 11 and an inner connecting member 22 fitted with the shaft 171 of the motor 17. The outer connecting member 21 is formed with several elongated projecting claws 211 for extending through the arch holes 153 of the inner rotor 15 and the central through hole 163 of the fuel outlet board 16. One end of the inner connecting member 22 is formed with several short projecting claws 221 and the other end of the inner connecting member 22 is formed with a rectangular hole 222. The front end of the shaft 171 extends into the rectangular hole 222 and the short claws 221 extend through the central through hole 163 of the fuel outlet board 16 into the spaces between the elongated projecting claws 211 of the outer connecting member 21 so as to engage therewith. By means of the outer and inner connecting members 21, 22, the shaft 171 of the motor 17 is connected with the inner rotor 15 for driving the same. Similarly, high accuracy of connection is not required.

Figure 1:
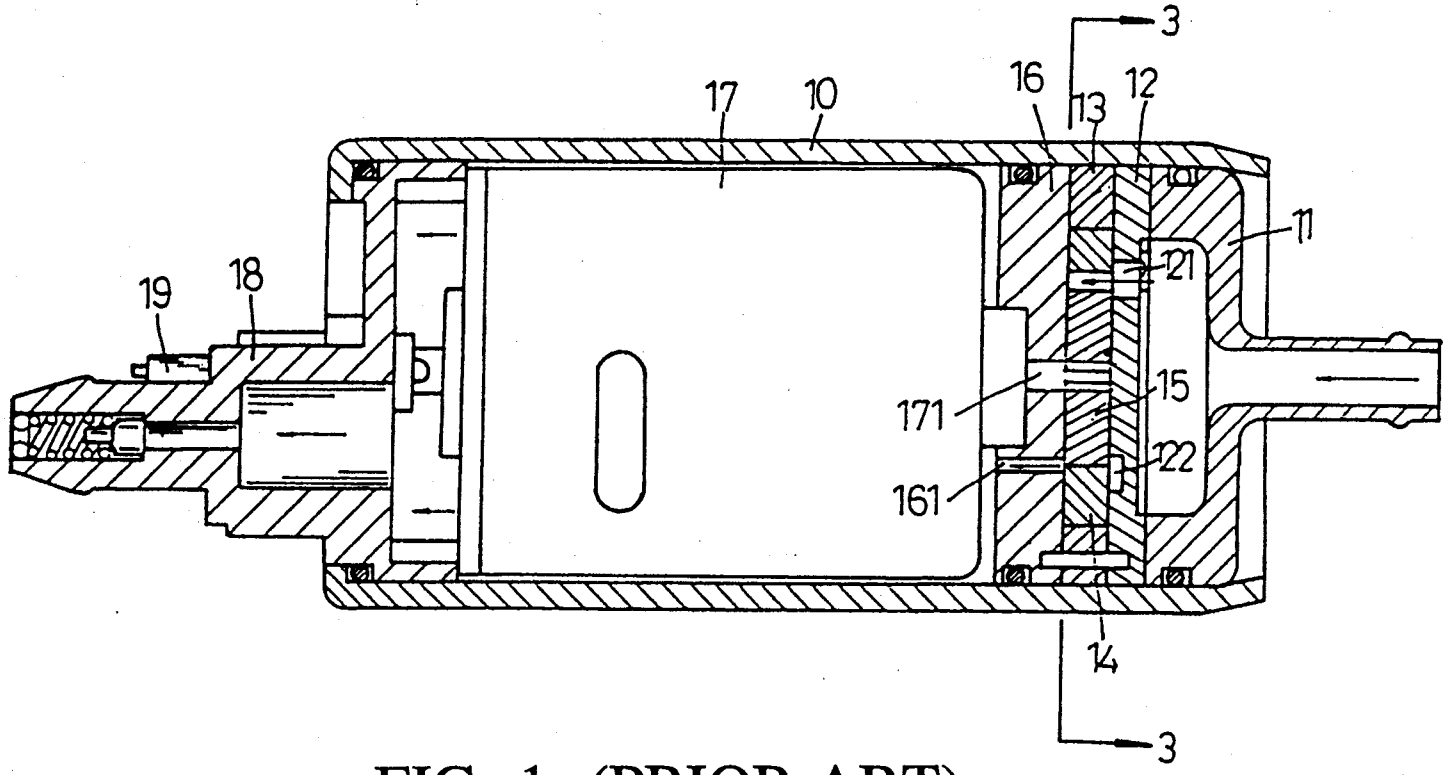
FIG. 1 (PRIOR ART)
FIG. 1 is an assembled sectional view of a conventional car-used electric fuel pump.
Figure 2:
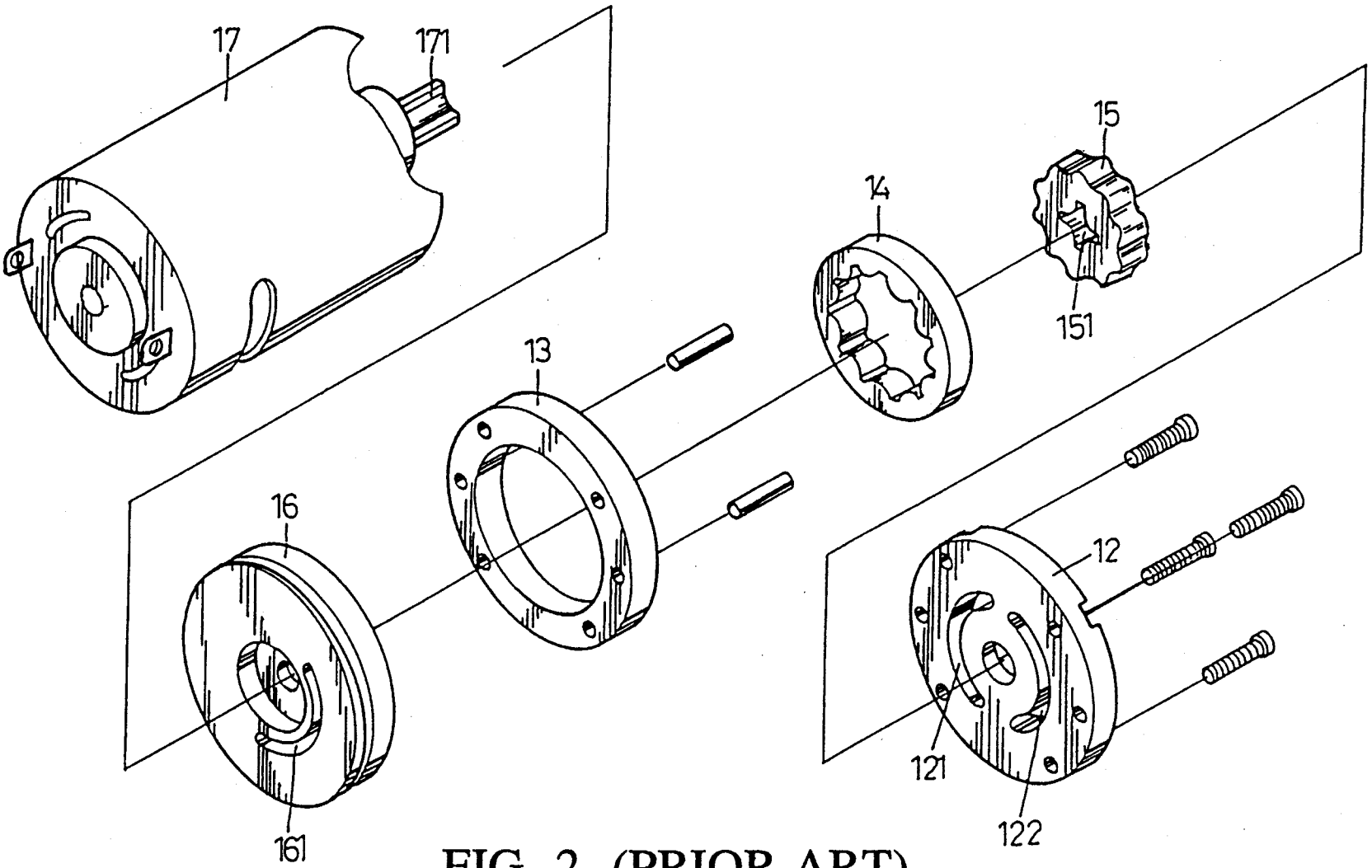
FIG. 2 (PRIOR ART)
FIG. 2 is an exploded view of a part of the conventional car-used electric fuel pump.
Figure 3:
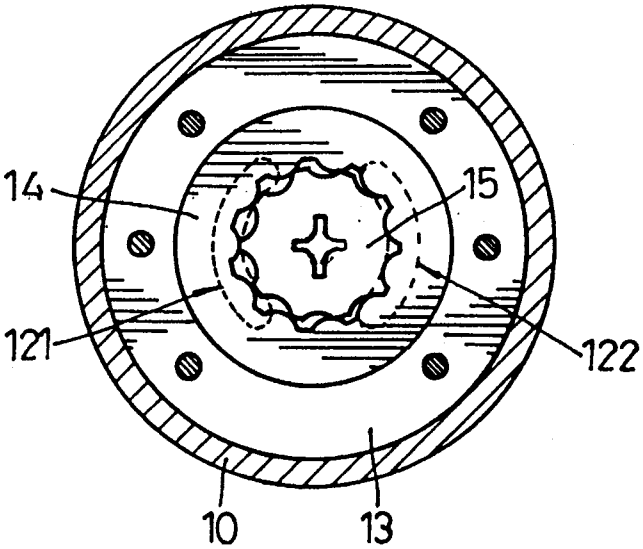
FIG. 3 (PRIOR ART)
FIG. 3 is a sectional view taken along line 3—3 of FIG. 1.

The operation and fuel-sucking/discharging procedure of the present invention is the same as shown in FIG. 3 and the previous description and will not be further described hereinafter.

In conclusion, the fuel outlet board 16 and connecting members 20, 21, 22 of the car-used electric fuel pump of the present invention are all made of engineering plastic so that the noise occurring during operation can be reduced. Moreover, the motor shaft is connected with the inner rotor by means of the connecting members so that high accuracy of connection therebetween is not necessary. This facilitates the assembling procedure of the pump. In addition, the gas-escaping valve disposed on the fuel outlet member is able to dissipate heat and lower the temperature of the pump so as to avoid danger.

The above preferred embodiments are only examples of the present invention and the scope of the present invention should not be limited to these examples. Any modification or variation derived from these examples should fall within the scope of the present invention.

What is claimed is:

1. A car-used electric fuel pump comprising:

a cylindric hollow housing;

a fuel inlet member fixedly disposed at one end of said housing;

an inner rotor having a central hole and outer teeth;

an outer rotor having inner teeth, said inner rotor being disposed in said outer rotor with said outer teeth of said inner rotor engaged with said inner teeth of said outer rotor, said fuel inlet member being formed with an arch fuel inlet, an opposite pressure-balancing groove and a projecting central fixing shaft which extends through said central hole of said inner rotor; and a DC motor disposed in said housing, a fuel outlet member being disposed at the other end of said housing behind said DC motor, said DC motor including a shaft having a flat front end, a brush seat and two brushes contacting with a positive and a negative electrodes which are integrally molded together with said fuel outlet member, said pump being characterized in that a fuel outlet board is disposed on an inner side of said fuel inlet member, said fuel outlet board being formed with an eccentric groove for receiving said inner and outer rotors, a fuel orifice being formed on said eccentric groove in alignment with said pressure-balancing groove of said fuel inlet member, said fuel outlet board being formed with a central through hole, several arch holes being formed around said central hole of said inner rotor, a cylindric hollow connecting member being through said central through hole of said fuel outlet board, one end of said connecting member being formed with several arch projecting claws which extend into said arch holes of said inner rotor, the other end of said connecting member being formed with a rectangular hole through which said flat front end of said shaft of said motor extends for connecting said motor and inner rotor, said fuel outlet member being disposed with a gas-escaping valve chamber communicating with inner space of said housing, a gas-escaping valve being disposed in said gas-escaping valve chamber, two ends of said gas-escaping valve being semi-spherically shaped and an annular projection is formed on a middle section of said gas-escaping valve, two springs abut against two sides of said annular projection, a gas-escaping valve stopper plate having a truncately conic opening being disposed at an exit of said gas-escaping valve chamber.

2. A car-used electric fuel pump comprising:

a cylindric hollow housing;

a fuel inlet member fixedly disposed at one end of said housing;

an inner rotor having a central hole and outer teeth;

an outer rotor having inner teeth, said inner rotor being disposed in said outer rotor with said outer teeth of said inner rotor engaged with said inner teeth of said outer rotor, said fuel inlet member being formed with an arch fuel inlet, an opposite pressure-balancing groove and a projecting central fixing shaft which extends through said central hole of said inner rotor; and a DC motor disposed in said housing, a fuel outlet member being disposed at the other end of said housing behind said DC motor, said DC motor including a shaft having a flat front end, a brush seat and two brushes contacting with a positive and a negative electrodes which are integrally molded together with said fuel outlet member, said pump being characterized in that a fuel outlet board is disposed on an inner side of said fuel inlet member, said fuel outlet board being formed with an eccentric groove for receiving said inner and outer rotors, a fuel orifice being formed on said eccentric groove in alignment with said pressure-balancing groove off said fuel inlet member, said fuel outlet board being formed with a central through hole, several arch holes being formed around said central hole of said inner rotor, an outer connecting member and an inner connecting member, said outer connecting member being fitted with said fixing shaft of said motor, said outer connecting member being formed with several elongated projecting claws for extending through said arch holes of said inner rotor and said central through hole of said fuel outlet board, one end of said inner connecting member being formed with several short projecting claws and the other end of said inner connecting member being formed with a rectangular hole, said front end of said shaft of said motor extending into said rectangular hole and said short claws extending through said central through hole of said fuel outlet board into the spaces between said elongated projecting claws of said outer connecting member so as to engage therewith, said fuel outlet member being disposed with a gas-escaping valve chamber communicating with inner space of said housing, a gas-escaping valve being disposed in said gas-escaping valve chamber, two ends of said gas-escaping valve being semi-spherically shaped and annular projection is formed on a middle section of said gas-escaping valve, two springs abut against two sides of said annular projection, a gas-escaping valve stopper plate having a truncating conic opening being disposed at an exit of said gas-escaping valve chamber.

* * * * *